United States Patent [19]

Towle et al.

[11] Patent Number: 4,546,984

[45] Date of Patent: Oct. 15, 1985

[54] TARGET FOR PROJECTILES

[75] Inventors: Alan L. Towle; Milton A. Towle, both of Wausau, Wis.

[73] Assignee: Sure Stop Manufacturing, Inc., Wausau, Wis.

[21] Appl. No.: 461,545

[22] Filed: Jan. 27, 1983

[51] Int. Cl.[4] ..... F41J 3/00

[52] U.S. Cl. ..... 273/404; 273/407; 273/408

[58] Field of Search ..... 273/404, 407, 408, 395; 428/247, 252, 255, 198, 107

[56] References Cited

U.S. PATENT DOCUMENTS

| | | | |
|---|---|---|---|
| 1,525,339 | 2/1925 | Toohey | 273/407 |
| 2,059,365 | 11/1936 | King | 273/395 X |
| 2,657,058 | 10/1953 | Mulcahy | 273/395 X |
| 3,164,384 | 1/1965 | Stewart | 273/404 |
| 3,367,660 | 2/1968 | Di Maggio | 273/404 |
| 3,558,140 | 4/1969 | Romeo | 273/410 X |
| 3,902,721 | 9/1975 | Piccini | 273/404 |
| 3,949,111 | 4/1976 | Pelletier | 428/107 X |
| 4,042,240 | 8/1977 | Kinart | 273/404 |
| 4,054,288 | 10/1977 | Perrine, Sr. | 273/408 |

FOREIGN PATENT DOCUMENTS

| | | | |
|---|---|---|---|
| 2932778 | 3/1981 | Fed. Rep. of Germany | 273/404 |
| 85106 | 5/1965 | France | 273/395 |
| 2438249 | 6/1980 | France | 273/403 |
| 206755 | 8/1966 | Sweden | 273/407 |

OTHER PUBLICATIONS

Stanley Hips Broadhead Target, 10-1979.

Archery, 1-1978, p. 33, Promat Magnum Target.

Archers Bible, 1966-1967, p. 9, 3-1967, Saunders "Toughenized" Target.

*Primary Examiner*—Paul E. Shapiro

*Attorney, Agent, or Firm*—Burns, Doane, Swecker & Mathis

[57] ABSTRACT

The present invention relates to a target preferably for use with pointed projectiles such as arrows. The target includes a target portion completely penetrable by the projectile. A backing portion is arranged behind and spaced from the target portion for preventing passage of the projectile completely through the target portion. The target portion includes at least one body portion having a thickness and a density sufficient to retain the projectile in the location and angular orientation at which the projectile passes through the target portion. An arrangement for physically stabilizing the body portion is arranged over substantially the entire surface area of a face of the body portion. In the preferred embodiment, the arrangement for physically stabilizing the body portion comprises a network having first and second pluralities of generally mutually perpendicular cords which are secured to one another at each intersection thereof.

13 Claims, 5 Drawing Figures

TARGET FOR PROJECTILES

BACKGROUND AND SUMMARY OF THE PRESENT INVENTION

The present invention relates to a target for use with projectiles. More particularly the present invention relates to an archery tarqet for use with pointed projectiles such as arrows.

Archery targets of various configurations are known. One old and well known type of archery target includes a straw or hay stuffing enclosed by a burlap material. Various modifications of the material used for the stuffing of such archery targets have also been proposed. Further, archery targets comprised of laminations of rubber layers, screens or other materials are disclosed for example in U.S. Pat. Nos. 1,818,939 issued Aug. 11, 1931 to Brading; 3,367,660 issued Feb. 6, 1968 to DiMaggio; and 3,476,390 issued Nov. 4, 1969 to Roloff et al.

A further type of archery target which has been proposed includes spaced apart panels comprised of screens or sheets and a backstop material spaced behind tne target sheets such that an arrow or other projectile penetrates the spaced apart panels and is stopped by the backstop sheet to prevent full passage of the arrow through the target panels. Targets of this latter type are disclosed in U.S. Pat. Nos. 1,602,441 issued Oct. 12, 1926 to Mallery; 2,193,727 issued Mar. 12, 1940 to Joaffray; 3,902,721 issued Sep. 2, 1975 to Piccini; and 4,042,240 issued Aug. 16, 1977 to Kinart.

Even with the numerous attempts to provide an acceptable archery target, there is still room for improvement. In particular, an archery target must be both relatively simple to construct and easy to transport. Further, it is highly desirable to provide an archery target which will retain an arrow or other projectile in the location and the orientation at which the arrow passes through the target to better assess the accuracy of the archer's shot. Still further, the archery target must be adapted for receiving a large number of arrows without substantial deterioration of the target material. The target must also be of rugged construction without being too bulky for easy transportation and movement. In addition, it is highly desirable to provide a tarqet which may be easily moved to a different angular orientation relative to a vertical line, particularly to permit use of the tarqet in areas which are not perfectly level. Moreover, it is desirable to provide a target that may be easily disassembled for easier storage during periods of non-use. In addition, the archery target should be made of a material which does not cause scratching or wear on arrows passed therethrough and permits easy removal of the arrows.

These highly desirable objects and others are achieved by an archery target according to the present invention. The archery target according to the present invention includes a target portion which is completely penetrable by a pointed projectile or arrow. A backing portion arranged behind and spaced from the target is provided for preventing passage of the pointed projectile completely through the target portion. The target portion includes at least one body portion having a thickness and a density sufficient to retain a projectile in the location and the angular orientation at which the projectile passes through the target portion. Further, the target portion includes an arrangement for physically stabilizing or reinforcing the body portion over substantially the entire surface area of a face of the body portion.

In the preferred embodiment, the arrangement for physically stabilizing the body portion comprises a network having first and second pluralities of generally mutually perpendicular strand-like elements of cords. The strand-like elements or cords are secured to one another at each intersection of the mutually perpendicular pluralities of cords. In this way, the network provides a proper stabilization for the body portion of the target portion while not interfering with the passage of the projectiles through the body portion. Further, the network according to the present invention retains its stabilizing function even if an arrow severs one or more of the sectors of a single cord due to the securement of the perpendicular cords to one another at each intersection. The cords may be secured to one another at the intersections by simple knots or, in the case of plastic cords, the intersections of the cords may be secured to one another by thermal or chemical bonding.

In a particularly preferred embodiment of the present invention, the target portion includes two body portions comprised of a high density polyethylene foam. Faces of the body portions are secured to one another with the stabilizing network arranged between the faces. Such an arrangement is particularly effective for stabilizing the combined two body portions since the network is arranged substantially centrally therein. Also, the thickness of the combined body portions may be more easily increased without a loss of stability to ensure the ability of the body portions to retain the projectile or arrow at the location and angular orientation at which it passes therethrough.

According to a further aspect of the present invention, the target portion is arranged within a frame for securely holding the target. A support is provided for adjustably supporting the frame, and hence the target portion, in a predetermined angular orientation. In addition, an arrangement for retaining the back stop or backing portion spaced from a rear side surface or face of the target portion is secured to portions of the frame.

In a particularly preferred embodiment, the arrangement for retaining the backing or back stop material comprises elongated rods having one end secured to corners of the frame and having a hook at a free end which hook is adapted to engage openings or loops on the back stop or backing sheet material. The support for adjustably securing the frame comprises a leg assembly including two foot portions extending generally perpendicular to the plane of the target portion and arranged on each side of the frame. An intermediate portion of each of the leg assemblies includes a pivotable connection for releasably securing the frame to the leg assemblies.

BRIEF DESCRIPTION OF THE DRAWINGS

A preferred embodiment of the present invention will be described in greater detail with reference to the accompanying drawings, wherein like members bear like reference numerals, and wherein.

DETAILED DESCRIPTION OF THE PREFERRED EMBODIMENT

Figure 1:
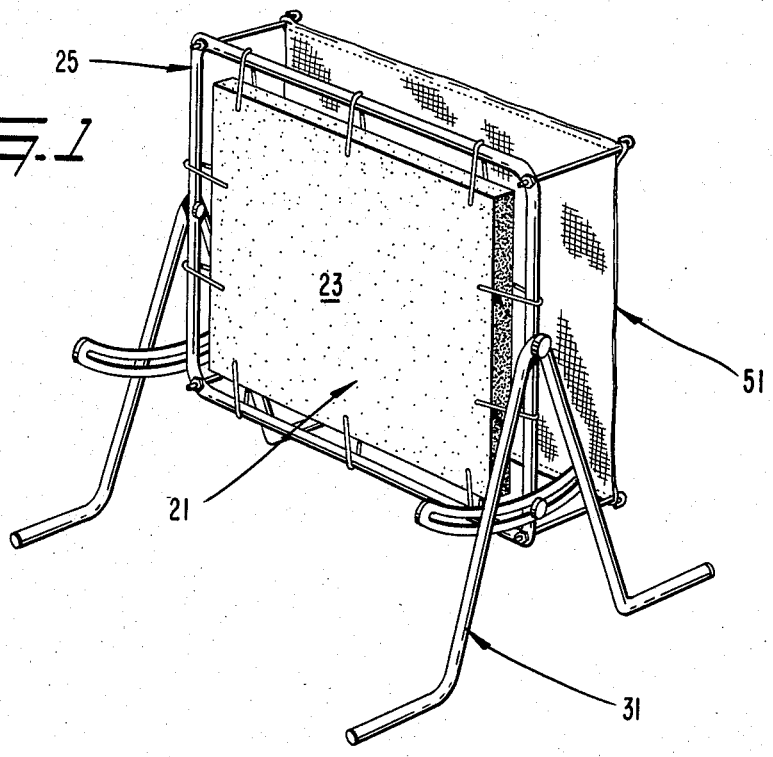
FIG. 1 is a perspective view of a target according to the present invention.

With reference to FIG. 1, a target according to the present invention includes a target portion 21 which is completely penetrable by a pointed projectile such as an arrow. The target portion 21 has a density and a thickness which is sufficient to retain the arrow at the location and the angular orientation at which the arrow passes through the target portion 21 after the arrow has been halted by a backing sheet or back stop 51 which will be discussed in greater detail subsequently. In other words, the material of the target portion 21 must be sufficiently dense and/or thick to hold the arrow in the orientation without being so thick and/or dense as to prohibit passage of the arrow or to deflect the arrow substantially from its incoming path. The target portion 21 is also sufficiently resilient to substantially obscure the opening through which the arrow passed after removal of the arrow without being too resilient as to make removal of the arrow difficult. The target portion 21 includes a front face 23 at which the arrows are directed.

The target portion 21 is encircled by a frame 25 for securely holding the target portion 21. The frame 25 comprises a generally rectangular member formed of tubular steel or aluminum components. For example, upper and lower portions of the frame 25 may be split such that two identical members are formed each including an entire side of the frame 25 and approximately half of both the upper and lower members. The two members are interconnected at the top and bottom of the target portion by any suitable arrangement such as bolts or a frame support rod which fits within the hollow profiles of the two members. The members may be formed. for example. from cold-rolled steel tubing having a 0.625 inch outside diameter and a 0.049 inch thickness.

The target portion 21 is preferably secured to the frame 25 by a plurality of tie straps 27 preferably of nylon. The tie straps are passed through openings 29 provided in the target portion 21 and then wrapped around the outside of the respective side of the frame 25 and secured in a known manner. The tie straps 27 permit relatively easy adjustment of the tension on the target portion 21 during use of the archery target.

Figure 2:
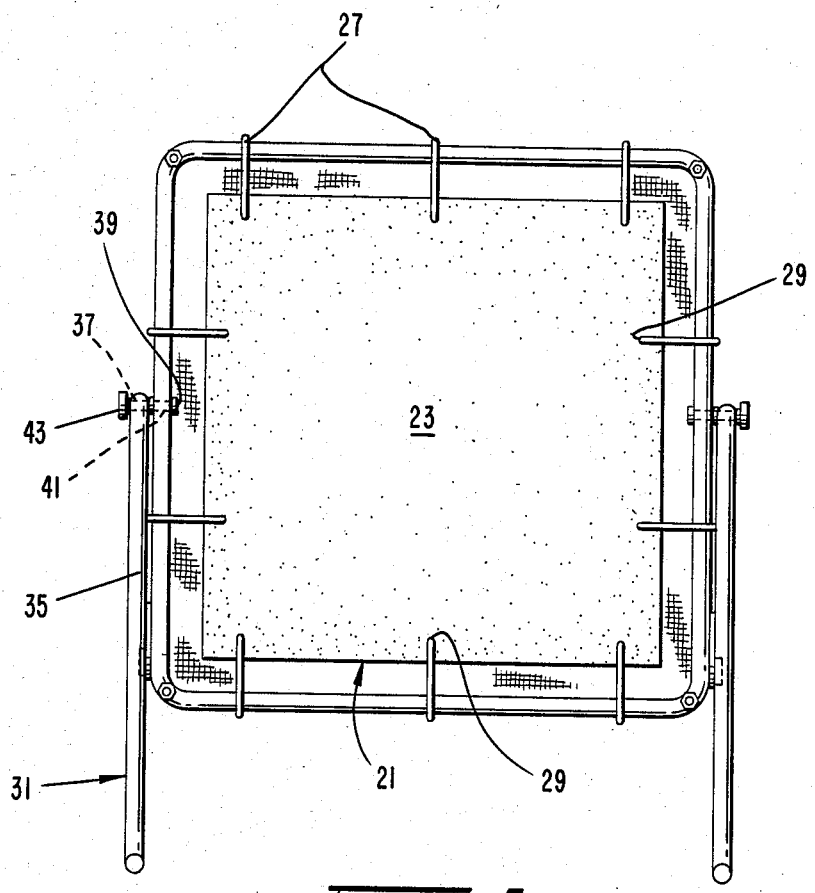
FIG. 2 is a front view of the target of FIG. 1.

The archery target includes supports in the form of leg assemblies 31 arranged on either side of the frame 25. Each of the leg assemblies (FIG. 3) includes two foot portions 33 extending generally perpendicular to the plane of the target portion 21. The foot portions 33 are interconnected by an intermediate portion 35 which, in the illustrated embodiment, comprises an inverted, generally V-shaped tubing section. The foot portions 33 and the intermediate portion 35 are preferably formed as a single unit from a suitable steel or other metal. At an upper end of the intermediate portion 35, a bore 37 (FIG. 2) is provided for receiving a bolt 39 which passes from an inside surface of the frame 25 through a complimentary bore 41 in the frame 25 and the bore 37 in the intermediate portion 35. A hand wheel 43 is provided on an outside of the leg assembly 31 to adjustably secure the leg assembly 31 to a frame 25.

As can be appreciated, loosening of the hand wheel or knob 43 permits the entire frame 25 with the target portion 21 secured thereto to be tilted around a horizontal axis and relative to a vertical plane for securement in a desired location by re-tightening the hand wheel 43. Also, since the front and rear faces of the target portion 21 are preferably identical, the bores 41 in the frame 25 are preferably provided at approximately the middle point on the side members of the frame 25 in order to permit rotation of the target portion 21 to present the opposite face as the front face 23. In this way, the useful life of the target portion is substantially doubled. The top and bottom of the target portion can also be reversed by removal ot the bolts 39. In addition, by providing the bores 41 centrally on the frame members, an imbalance of the target portion 21 upon reversal of the front faces is avoided.

In order to improve control of the movement of the frame 25 relative to the leg support assemblies 31, a metal member 45 having an arcuate slot 47 therein is secured to the inside of the upstanding legs of the intermediate portion 35 of each of the support assemblies 31. A bolt and hand wheel assembly 49, similar to that arranged at the upper end of the intermediate portion 35, is provided for passing through the arcuate slot 47 and a complimentary opening in the frame 25 to further ensure that the frame 25 remains in the desiged angular orientation relative to the support assemblies 31. Second openings 50 are preferably arranged at an upper end of the frame side members so that the bolt and hand whee1 assembly 49 can be inserted when the target portion 21 is rotated through 180° as discussed above.

Figure 3:
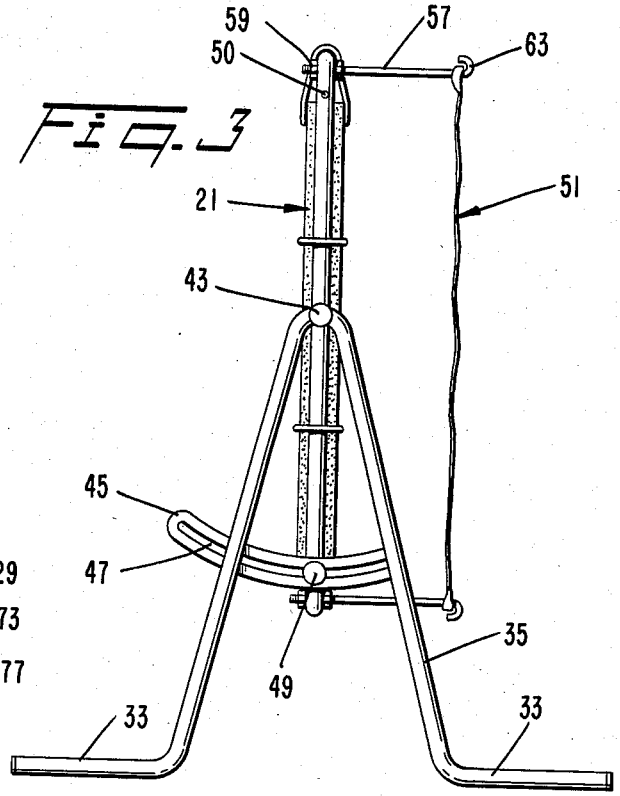
FIG. 3 is a side view of the target of FIG. 1.

In the archery target according to the present invention, the backing sheet or back stop 51 is arranged behind and spaced from a back face 55 of the target portion 21 (FIG. 3). The backing sheet or back stop 51 is comprised of a suitable material which is resistant to piercing by a point of a projectile or an arrow which passes through the target portion 21. A suitable material has been found to be a cable knit polyester material. The distance by which the back stop 51 is arranged behind the target portion 21 should be sufficient to permit full passage of the tip of an arrow through the target portion 21 without permitting the entire arrow, e.g., the feathers at the back end thereof, to pass through the target portion 21. The backing sheet 51 is preferably arranged somewhat loosely to facilitate absorption of the force of the arrow as the arrow strikes the backing sheet 51.

Figure 5:
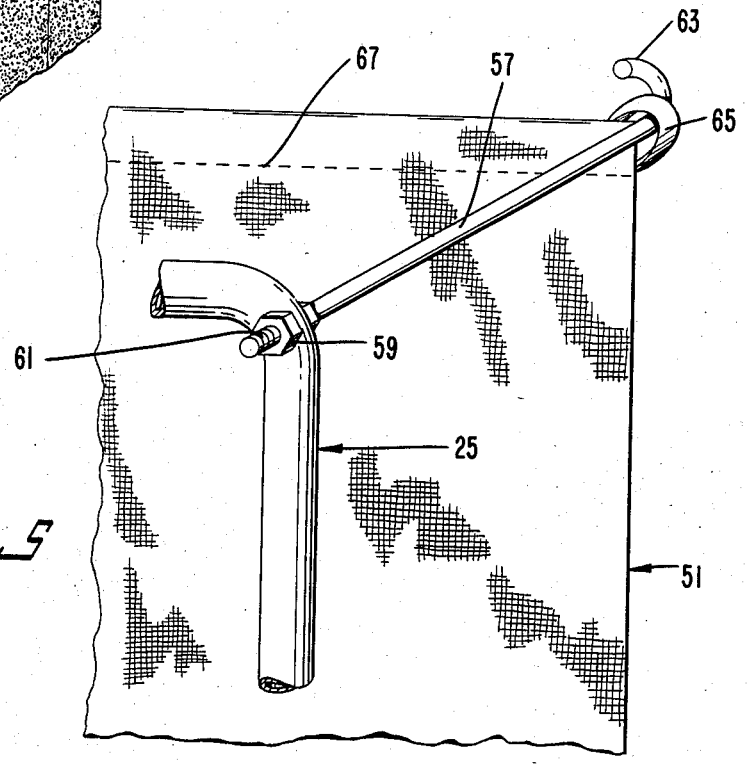
FIG. 5 is an enlarged view of a portion of FIG. 1 illustrating the arrangement for retaining a backing sheet or back stop of the target.

The backing sheet 51 is retained in the spaced relation relative to the back face 55 of the target portion 21 by a plurality of rod member 57 which are secured to respective corners of the frame 25 in any suitable manner, for example, by a nut 59 arranged on a threaded end 61 of the rod member 57 which end passes through suitable openings in the corners of the frame 25 (FIG. 5). The opposite end of the rod member 57 preferably includes a hook 63 which passes through a loop 65 secured to the back stop 51, for example, by a suitable stitching 67. It should be noted that the loop 65 may be replaced by suitable reinforced openings (not shown) provided directly in the back stop material 51.

Figure 4:
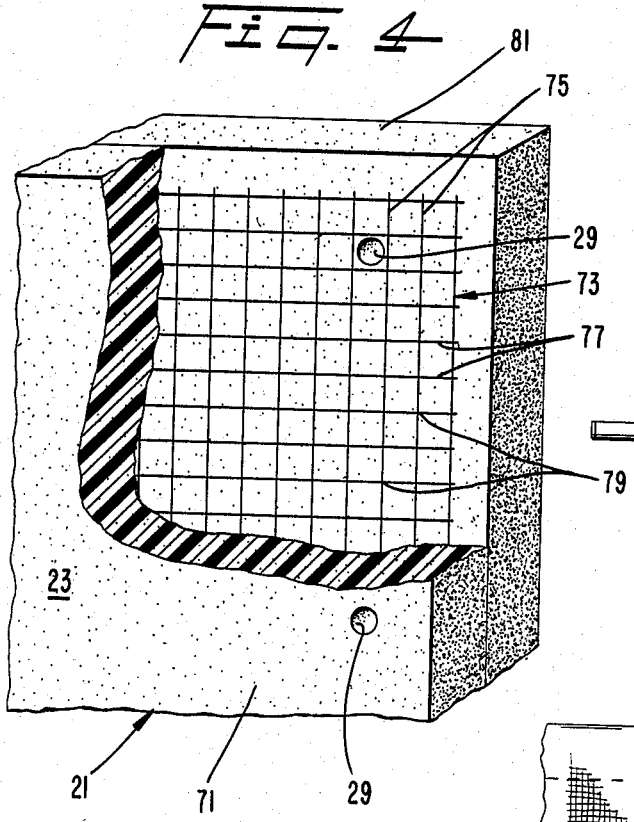
FIG. 4 is an enlarged, partially cut-away view of a portion of FIG. 1 illustrating the structure of a target portion of the target.

The construction of the target portion 21 will be described in greater detail with particular reference to FIG. 4. The target portion 21 includes at least one penetrable block 71 of material. As noted previously, the block 71 is made of a material which is sufficiently dense and thick to retain a projectile or arrow in the location and angular orientation at which it passes through the block 71. A material found to be particularly suitable for the purpose is a high density polyethylene foam. A foam of this type is sold by Adams Foam Co. of Chicago, Ill. under the general designation of Series 1770 polyethylene high density retractable-expandable foam having a density of approximately 1.7 $lb/ft^3$.

In order to ensure the retention of the arrow in the location and the angular orientation at which it passes through the block 71, the thickness of the preferred polyethylene foam should be between $\frac{3}{4}$ of an inch to 2 inches in a direction perpendicular to the plane of the block 71. The material of the block 71 is also sufficiently resilient such that removal of an arrow which has passed therethrough does not leave a distinct hole within the material of the block 71. Also, removal of an arrow from the block 71 is not particularly difficult.

The preferred materials for the block 71 have been found to be insufficiently rigid to prevent sagging of the block 71 after hanging the block 71 within the frame 25 for a period of time. In accordance with the present invention, a member 73 for reinforcing or physically stabilizing the block or body 71 is arranged over substantially the entire surface area of a face of the block 71. The member 73 does not substantially interfere with the penetrability of the block 71 to the projectile but merely serves to stabilize or reinforce the block 71 to prevent sagging of the block 71 during use.

A suitable reinforcement member 73 has been found to be a network or mesh comprised of generally mutually perpendicular first and second pluralities of cords or strand-like elements 75 and 77, respectively. In the illustrated embodiment, the pluralities of cords 75, 77 are arranged generally vertically and horizontally. However, it is to be understood that the reinforcement member 73 according to the present invention would function equally well if arranged in a different angular orientation.

The cords 75, 77 are secured to one another at each intersection 79 thereof in order to substantially prevent movement of a single cord along its entire longitudinal length and to enhance the stabilizing function of the member 73. The securement is preferably accomplished by simple knotting of each cord around each cord of the perpendicular plurality of cords. Alternatively, if the cords are made of a plastic material, such as nylon, the cords may be thermally or chemically bonded to one another at each intersection 79 thereof. An available knotted network sold by Midlakes Mfg. of Knoxville Tenn. has been found to be somewhat less likely to destructively rupture or disintegrate upon being impacted by a projectile than certain commercially available networks having thermally or chemically bonded intersections.

As noted previously, the member 73 is primarily provided for reinforcement or for physically stabilizing the block 71 rather than for the purpose of acting upon an arrow passing through the block 71, for example, for slowing or retaining the arrow in the initial angular orientation. It should be noted that the stabilization of the block is still accomplished even if an arrow passes directly through, and hence severs, one of the segments of one of the cords 75, 77 due to the secure attachment of each of the cords at each intersection with the mutually perpendicular cords. In other words, the reinforcement member 73 forms a mesh or network which retains its stabilizing function even if portions of certain ones of the cords are pierced or cut. The mesh size of the reinforcement member is preferably between $\frac{1}{4}$ inch to $\frac{1}{2}$ inch.

The reinforcement member 73 may be secured to a back face of a single block 71 in any suitable manner to perform the desired function. However, in the preferred embodiment, a second block 81 having dimensions substantially the same as the block 71 is included in the target portion 21. In the preferred embodiment, the reinforcement member 73 is arranged between the two foam blocks 71, 81 which are subsequently glued or otherwise bonded to one another along their abutting faces. With this arrangement, the reinforcement member 73 is securely held between the blocks or body portions 71, 81 and provides reinforcement generally centrally within the completed target portion 21. In this way, the target portion has two identical faces to permit reversal of the front and rear faces to extend the useful life of the target portion. Also, disengagement of the reinforcing member 73 from the faces of the block is substantially eliminated.

Still further, the thickness required to properly retain a projectile at the location and the angular orientation at which it passes through the target member, which thickness may be as great as 2 inches can be readily obtained by glueing the two blocks 71, 81 together. It is again noted that by providing the reinforcement member 73 centrally within the total thickness of the target portion, the physical stability of the target portion is enhanced. In other words, arranging the reinforcement member 73 on the back of a 2 inch block 71 of foam may not produce the desired stability on the forward face 23 of the target portion 21.

Again with reference to FIG. 4, the openings 29 provided in the target portion 21 pass through the first block 71 the reinforcement member 73 and the second block 81. While in the illustrated embodiment, the openings 29 pass within the mesh of the reinforcement member 73, such an arrangement is not critical to the function of the reinforcement member 73. As noted previously, since each intersection of the reinforcement member is securely held, the piercing of one section of one of the cords 75, 77 by the openings 29 does not substantially impair the ability of the reinforcement member 73 to physically stabilize and reinforce the target portion 21.

As can be seen, the present invention provides an improved archery target over those of the prior art. In particular, the archery target according to the present invention is both relatively simple in construction and lightweight for easy transportation. By employing foam blocks for the target portion 21 and a simple sheet material for the back stop 51, the weight of the target is substantially reduced. Further, the present invention provides an archery target which may be easily disassembled for compact storage by simple removal of the hand wheels 49 and 43. Still further, the hand wheels provide a ready adjustment of the angle of inclination of the target portion 21 relative to the ground surface such that the archery target may be used on uneven surfaces and permit relatively easy rotation of the target so that both faces of the target portion 21 may be utilized. Moreover, the target portion of the target according to the present invention effectively retains the projectile or arrow in the location and the angular orientation at which it passes through the target portion while providing a target portion which is capable of repeated uses without substantial deterioration.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Therefore, it is expressly intended that all such variations and changes which fall within the spirit and scope of the present invention as defined in the claims be embraced thereby.

What is claimed is:

1. An archery target comprising: first and second penetrable foam blocks, said blocks having a density and a combined thickness sufficient to retain a pointed projectile both in the location and at the angular orientation at which the projectile passes through the blocks;

a reinforcement member for adding stability to the first and second blocks;

said first and second blocks being secured together along faces thereof with the reinforcement member secured therebetween, the reinforcement member covering substantially the entire surface area of the faces; and said reinforcement member comprising mutually perpendicular first and second pluralities of spaced, strand-like cords, said cords being secured to one another at each intersection point thereof.

2. The archery target of claim 1, wherein the cords are secured to one another at the intersection points by knots.

3. The archery target of claim 1, wherein the cords are nylon, the cords being secured to one another at the intersection points by thermal welding.

4. The target of claim 1, further comprising:

a backing portion arranged behind and spaced from said foam blocks for preventing passage of the projectile completely through said foam blocks.

5. The target of claim 1, further comprising a frame for securely holding the blocks.

6. The target of claim 5, further comprising openings extending through the foam blocks and the reinforcement member, the openings being adapted to receive fasteners for holding the blocks within the frame.

7. The target of claim 1, wherein the foam blocks are comprised of high density polyethylene.

8. The target of claim 1, further comprising:

frame means for securely holding said foam blocks;

support means for adjustably supporting the frame means in a predetermined angular orientation;

stop means for stopping movement of a projectile after passing partially through the penetrable foam blocks;

means secured to portions of the frame means for retaining said stop means at a location spaced from a rear side surface of said penetrable foam blocks.

9. The target of claim 8, wherein front and rear faces of the assembled foam blocks are substantially identical, the support means permitting rotation of the foam blocks through 180° degrees to reverse the respective faces of the foam blocks.

10. The target of claim 8, wherein the support means comprises a leg assembly adjustably secured to each side of the frame means, each leg assembly including two foot portions extending generally perpendicular to the plane of the foam blocks, an intermediate portion having means for pivotably connecting the frame portion to the leg assemblies.

11. The target of claim 10, further comprising an arcuate slot on the intermediate portion of each leg assembly for guiding pivotal movement of the frame means relative to the leg assemblies.

12. The target of claim 8, wherein the retaining means for the stop means comprises rod members secured to corners of the frame means, the rod members terminating in a hook adapted to engage reinforced openings on the stop means.

13. The target of claim 8, wherein the frame means includes a frame structure encircling the foam blocks, and a plurality of fasteners extending between the frame structure and a respective one of a plurality of openings provided in the penetrable foam blocks.

* * * * *